US006880715B2

(12) United States Patent
Tanabe et al.

(10) Patent No.: US 6,880,715 B2
(45) Date of Patent: Apr. 19, 2005

(54) PACKAGING CONTAINER

(75) Inventors: Katsuei Tanabe, Niigata-ken (JP); Kazuo Asano, Niigata-ken (JP); Hiroei Takahashi, Niigata-ken (JP)

(73) Assignee: Bourbon Corporation, Niigata-ken (JP)

( * ) Notice: Subject to any disclaimer, the term of this patent is extended or adjusted under 35 U.S.C. 154(b) by 0 days.

(21) Appl. No.: 09/732,729

(22) Filed: Dec. 11, 2000

(65) Prior Publication Data

US 2001/0004984 A1 Jun. 28, 2001

(30) Foreign Application Priority Data

Dec. 9, 1999 (JP) ..... 11-350018

(51) Int. Cl.[7] ..... B65D 23/20; B65D 39/00

(52) U.S. Cl. ..... 220/23.86; 220/630; 220/787

(58) Field of Search ..... 220/23.86, 630, 220/787, 798, 737–740, 23.91, 23.87, 605; 229/403, 404; 248/105, 147, 346.11

(56) References Cited

U.S. PATENT DOCUMENTS

| | | | | | |
|---|---|---|---|---|---|
| 1,672,884 | A | * | 6/1928 | Gingras | 229/4.5 |
| 1,771,765 | A | * | 7/1930 | Benson | 229/4.5 |
| 2,672,742 | A | * | 3/1954 | Amberg | 248/145.3 |
| 2,907,491 | A | * | 10/1959 | Gunn | 220/298 |
| 3,232,512 | A | * | 2/1966 | Wanderer | 206/519 |
| 3,288,340 | A | * | 11/1966 | Shapiro et al. | 206/519 |
| 3,337,109 | A | * | 8/1967 | Shumrak | 220/738 |
| 3,355,080 | A | * | 11/1967 | Rausing et al. | 229/123.1 |
| 3,371,819 | A | * | 3/1968 | Zeman | 220/605 |
| 3,401,825 | A | * | 9/1968 | Weiss | 220/787 |
| 3,420,397 | A | * | 1/1969 | Miller | 220/203.09 |
| 3,596,795 | A | * | 8/1971 | D'Erocli | 206/514 |
| 3,653,575 | A | * | 4/1972 | Schrepper | 206/519 |
| 3,908,887 | A | * | 9/1975 | Leto | 220/574 |
| 4,069,996 | A | * | 1/1978 | Koziol | 141/391 |
| 4,210,272 | A | * | 7/1980 | Sequin | 215/253 |
| RE31,650 | E | * | 8/1984 | Serritella | 229/404 |
| 4,865,199 | A | * | 9/1989 | Zimmer | 206/514 |
| 4,909,393 | A | * | 3/1990 | Palisin, Jr. | 206/519 |
| 5,647,624 | A | * | 7/1997 | Beshara, Jr. | 294/27.1 |
| 5,667,135 | A | * | 9/1997 | Schaefer | 229/403 |
| 6,024,244 | A | * | 2/2000 | Hicks | 220/603 |
| 6,364,151 | B1 | * | 4/2002 | Gale | 220/738 |

* cited by examiner

*Primary Examiner*—Joseph C. Merek
(74) *Attorney, Agent, or Firm*—Wenderoth, Lind & Ponack, L.L.P.

(57) ABSTRACT

A packaging container has a container body formed of a shape substantially resembling an inverted cone. The packaging container can be set alone on a support surface and the contents, such as confectionery, of the packaging container can be removed without holding the packaging container by hand. The container package includes a container body formed of a shape substantially resembling an inverted cone and having a tapered end portion and an open end opposite the tapered end portion, a lid for hermetically sealing the container body, and a frustum-shaped exterior shell removably fitted on the container body. When the exterior shell fitted on the container body is removed from the container body and is inverted, and the tapered end portion of the container body is inserted into the inverted exterior shell, the container body is supported by the exterior shell. The container body is provided on its outer surface with protrusions. A smaller end of the exterior shell engages the protrusions formed on the outer surface of the container body when the exterior shell is fitted onto the container body.

8 Claims, 4 Drawing Sheets

PACKAGING CONTAINER

BACKGROUND OF THE INVENTION

1. Field of the Invention

The present invention relates to a packaging container and, more particularly, to a packaging container having a container body for containing confectionery and a lid capable of hermetically sealing the container body.

2. Description of the Related Art

A known packaging container intended for use as a confectionery container has a container body having a shape substantially resembling an inverted cone and an open end corresponding to a bottom of the inverted cone, and a lid for hermetically sealing the container body. In some packaging containers of this kind, a label having printed thereon a picture of confectionery contained in the packaging container, a trademark and the like is affixed to a side surface of the container body.

Such a confectionery container is held by one hand and confectionery contained in the confectionery container is taken out by the other hand for eating.

Since the container body of this confectionery container has a shape substantially resembling the shape of an inverted cone, the confectionery container is unable to hold itself in an upright position on a table or the like. The confectionery container must be supported on a stand or the like to place the same in an upright position on a table or the like.

SUMMARY OF THE INVENTION

Accordingly, it is an object of the present invention to solve the problem of the prior art confectionery container, and to provide a packaging container having a container body of a shape substantially resembling an inverted cone, and capable of supporting itself on a surface and enabling removal of its contents even if the container body is not held by hand.

With the foregoing object in view, the present invention provides a packaging container including a container body formed of a shape substantially resembling an inverted cone and having a tapered end portion and an open end opposite the tapered end portion, a lid for hermetically sealing the container body, and a frustum-shaped exterior shell removably fitted on the container body. When the exterior shell is removed from the container body and is inverted and a tapered end portion of the container body is inserted in the inverted exterior shell, the container body is supported by the exterior shell.

The exterior shell is fixedly fitted on the side wall of the container body when the packaging container containing confectionery is sold. When removing the confectionery contained in the packaging container, the exterior shell is removed from the container body and is inverted, and a tapered end portion of the container body is inserted into the inverted exterior shell so as to support the container body by the exterior shell. Thus, the container body of a shape substantially resembling an inverted cone can be supported by the exterior shell on a support surface without requiring any stand.

Preferably, a smaller end of the exterior shell is held fast to a side wall of the container body when the exterior shell is fitted onto the container body. Since the exterior shell has the shape of a frustum, the exterior shell can be firmly held on the container body by fastening the same to the container body only by a small end thereof, and a larger end of the exterior shell does not need to be held fast to the side wall of the container body. Therefore, the exterior shell can be easily removed from the container body.

Preferably, the smaller end of the exterior shell as fitted on the container body is lightly bonded to the side wall of the container body. Thus, the exterior shell can be easily removed from the container body, inverted and used for supporting the container body.

Preferably, protrusions are formed along the outer surface of the side wall of the container body and the smaller end of the exterior shell engages the protrusions when the exterior shell is fitted onto the container body. The engagement of the smaller end of the exterior shell with the protrusions of the container body secures the exterior shell in place when the exterior shell is fitted onto the container body. Thus, the exterior shell can be easily removed from the container body, inverted and used for supporting the container body. The exterior shell can be easily fitted onto the container body again.

Preferably, the exterior shell is formed to be of an axial length such that a tip of the tapered end portion of the container body fitted into the inverted exterior shell is spaced from a support surface. Thus, the exterior shell functions as a stand and supports the container body so that the tip thereof is spaced from the support surface.

Preferably, the protrusions are formed on the side wall of the container body at positions on the side of the tapered end portion of the container body with respect to an axially middle portion of the side wall of the container body. Thus, the tip of the container body can be spaced from a support surface when the smaller end of the exterior shell engages the protrusions.

Preferably, the protrusions are arranged at intervals or continuously as a ring in a plane perpendicular to an axis of the container body. The projections give an esthetic effect to the design of the container body in addition to a functional effect.

DESCRIPTION OF THE PREFERRED EMBODIMENTS

Packaging containers in preferred embodiments according to the present invention will: be described hereinafter with reference to the accompanying drawings.

As shown in FIGS. 1 to 5, a packaging container 1 in a first embodiment according to the present invention includes a container body 2, a lid 3 and a exterior shell 4.

Figure 4:
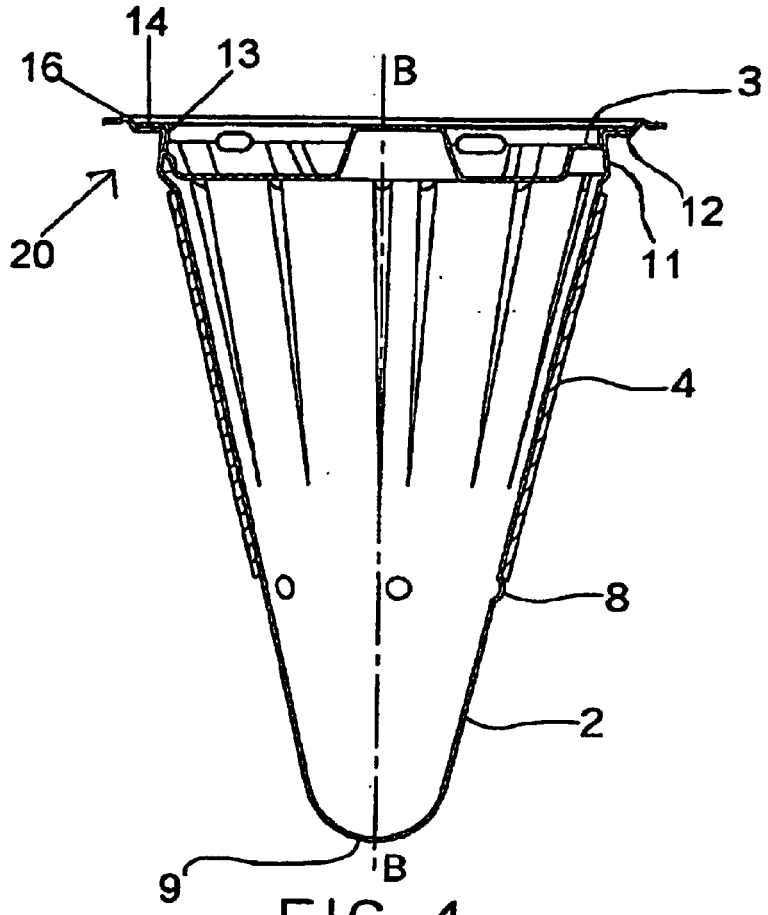
FIG. 4 is a sectional view of the packaging container shown in FIG. 3 taken on line A-B-C in FIG. 5.
Figure 5:
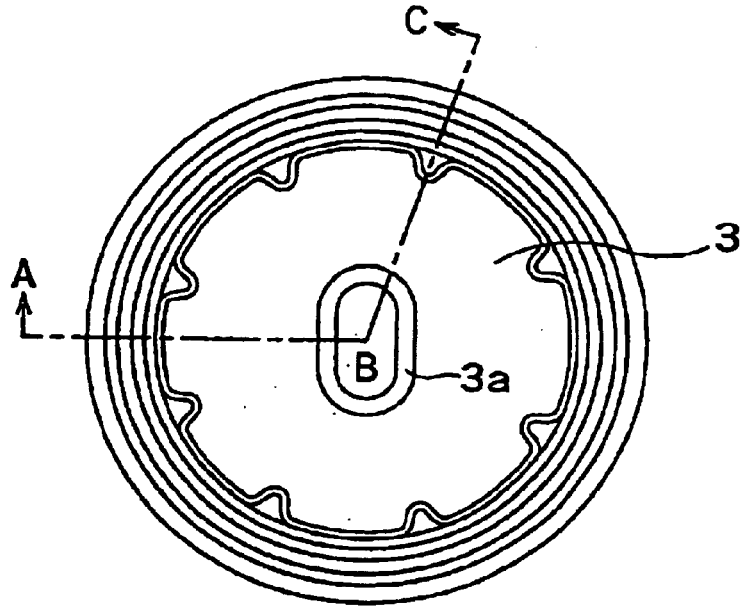
FIG. 5 is a plan view of the lid.

The container body 2 is provided along an outer circumference of its side wall with eight esthetic, longitudinal grooves 7 extending from a brim of an open end 6 thereof to a middle portion of the side wall. As shown in FIG. 4, at an upper end of the side wall of the container body is a portion 11 that extends in a direction toward an axis passing through the open end 6 and the tapered end portion 5 of the container body. In other words, this portion 11 is angled toward the axis.

A plurality of semispherical small protrusions 8, six semispherical small protrusions in this embodiment, are formed along the outer circumference of the side wall of the container body 2. The small protrusions 8 are arranged in a plane perpendicular to an axis of the container body 2. The protrusions 8 are formed at positions on a side of a tapered end portion 5 of the container body with respect to an axially middle portion of the side wall of the container body 2. The protrusions may be esthetically arranged at intervals in the plane perpendicular to the axis of the container body 2, or may be arranged continuously as a ring. The protrusions 8 can be formed so as to exercise a function to engage a smaller end of the exterior shell 4 and also to give an esthetic effect to the design of the container body 2. The tapered end portion 5 has a rounded distal end 9 such that the container body 2 cannot be supported in an upright position by the rounded distal end when the rounded distal end is placed on a support surface.

Figure 1:
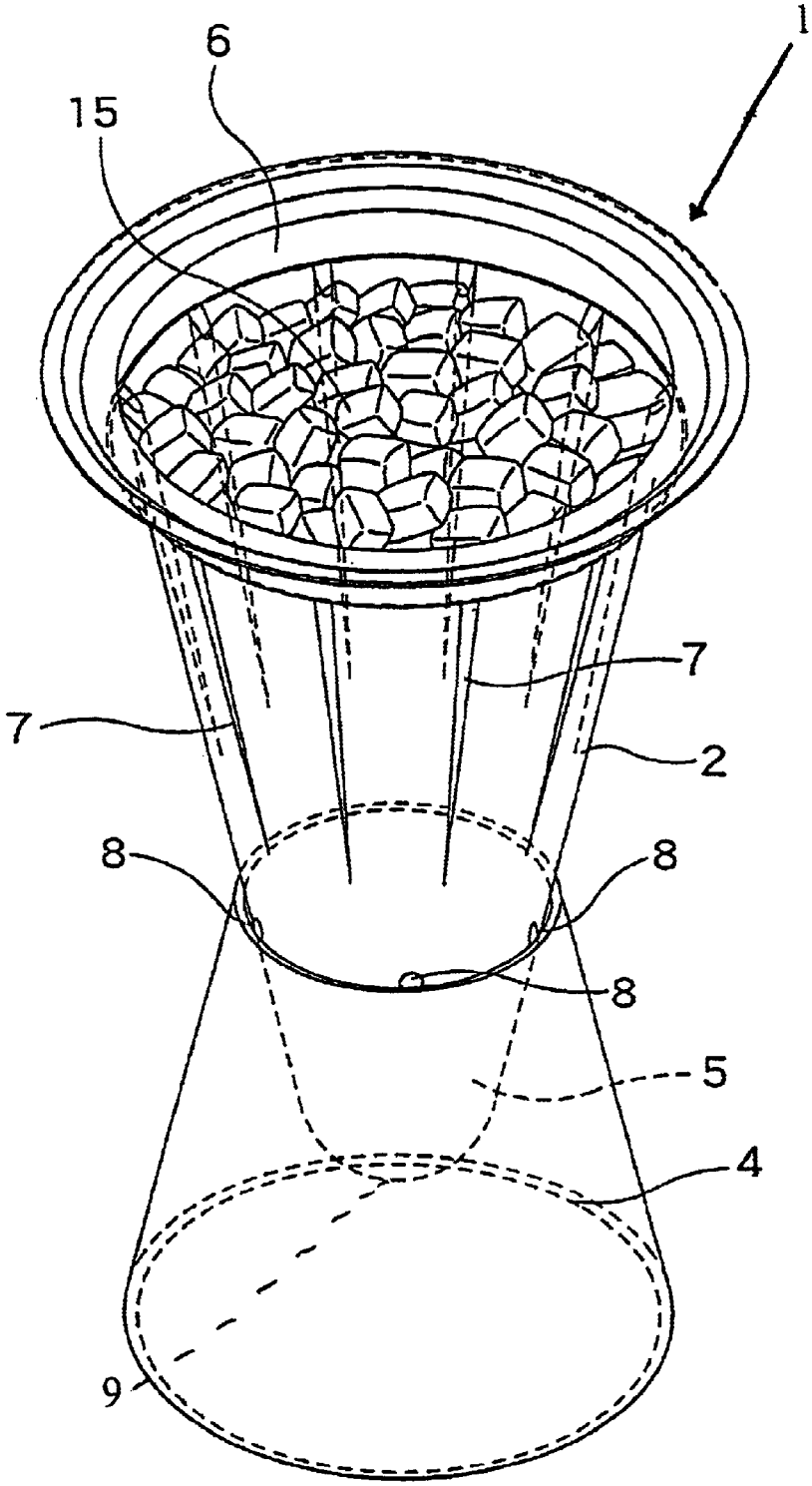
FIG. 1 is a perspective view of a packaging container in a preferred embodiment according to the present invention, in which a lid is removed.
Figure 2:
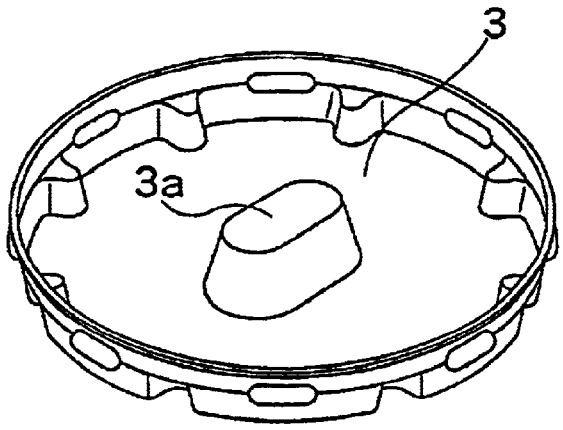
FIG. 2 is a perspective view of a lid included in the packaging container shown in FIG. 1.

As shown in FIG. 1, confectionery 15, such as chips of confectionery, is contained in the container body 2.

Also as shown in FIG. 4, a flange 20 is at the open end of the container body 2. The flange 20 includes a first portion 12 that extends away from the portion 11 in radial direction of the container body 2. The flange 20 further includes a second portion 16 that extends outwardly away from the first portion 12. The lid 3 includes a first portion 13 and a second portion 14 extending away from the first portion 13. The lid 3 is put on the container body 2 such that the first portion 14 of the lid 3 is received within the portion 11 while the second portion 14 of the lid 3 is received on the first portion 12 of the flange 20 such that an outer peripheral edge of the second portion of the lid is positioned radially inwardly of the second portion 16 of the flange, so as to seal the open end 6 of the container body 2. The lid 3 is provided on its upper surface with a knob 3*a*. The lid 3 is put on the container body 2 to close the open end 6, and is taken off the container body 2 to open the open end 6, by holding the knob 3*a* between fingers and either lifting or lowering the lid.

The exterior shell 4 is formed in the shape of a frustum having a smaller end and a larger end by adhesively joining together opposite ends of a paper sheet or the like. The exterior shell 4 can be used as a label for showing a picture of confectionery contained in the packaging container 1, a trademark and the like. In FIG. 1, a picture, a trademark and the like printed on the surface of the exterior shell 4 are omitted.

Figure 3:
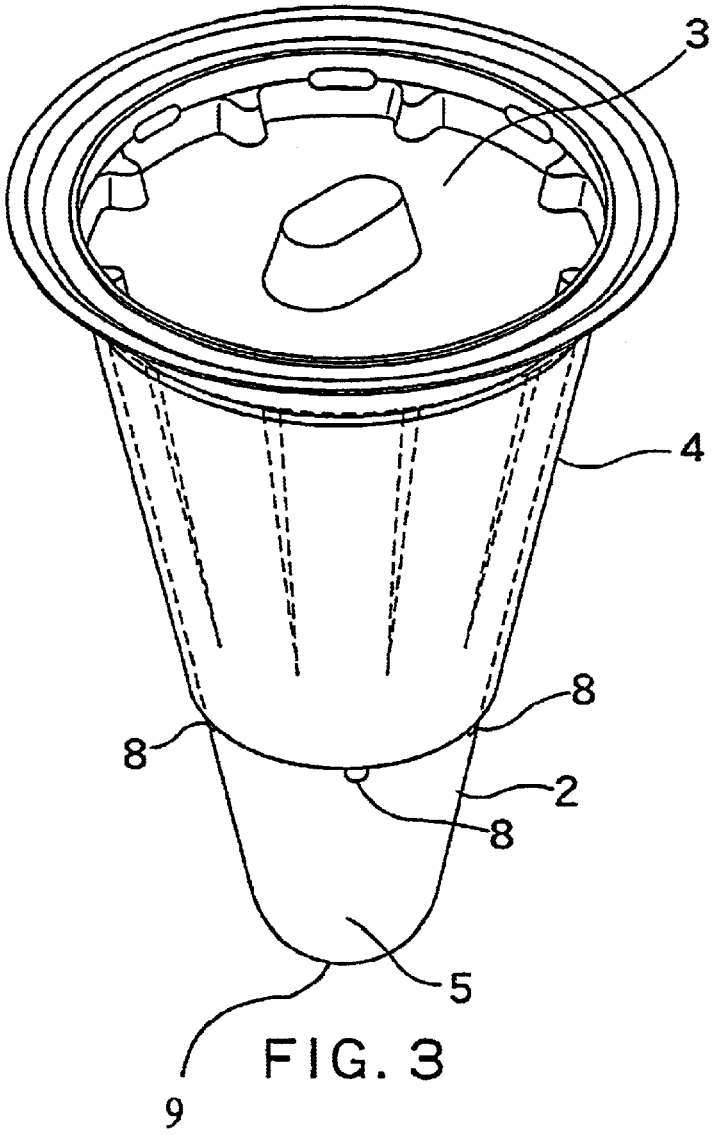
FIG. 3 is a perspective view of the packaging container shown in FIG. 1 in a sealed state.

As shown in FIG. 3, the smaller end of the exterior shell 4 is on an upper side of the protrusions 8 and the larger end of the exterior shell is in close contact with a portion of the side wall of the container body 2 near the open end 6 of the container body 2 before the packaging container 1 is opened. The larger end of the exterior shell 4 is not joined adhesively to the container body 2. Since the exterior shell 4 has the shape of a frustum, the exterior shell 4 can be securely held on the container body 2 by fitting the exterior shell 4 on the container body 2 so that only the smaller end thereof engages the container body firmly and the larger end thereof is in loose engagement with the container body 2. Thus, the exterior shell 4 can be easily removed from the container body 2.

The exterior shell is formed to be a predetermined axial length, such that a tip of the tapered end portion 5 of the container body 2 fitted in the exterior shell 4 in an inverted condition is spaced apart from a support surface on which the exterior shell is placed. The axial length of the exterior shell 4 is, for example, greater than half the axial length of the container body 2.

The smaller end of the exterior shell 4 is disengaged from the protrusions 8 and the exterior shell 4 can be removed from the container body 2 by pulling the exterior shell 4 toward the tip of the tapered end portion 5. The exterior shell 4 removed from the container body 2 is inverted and a tapered end portion of the container body 2 is inserted through the smaller end in the exterior shell 4. Then, the smaller end of the exterior shell 4 engages lower portions of the protrusions 8 as shown in FIG. 1, and the exterior shell 4 serves as a stand for supporting the container body 2 on a support surface. When leaving the confectionery 15 half eaten, so as to eat the residual confectionery 15 later, the exterior shell 4 in a state shown in FIG. 1 is removed from the container body 2, is inverted and is fitted onto the container body 2 as shown in FIG. 3, and the lid 3 is put on the container body 2 to close the open end 6 of the container body 2.

Thus, the container body 2 having a shape substantially resembling an inverted cone can be supported on a support surface by the exterior shell 4.

The exterior shell 4 serves as a support, as well as a label when printed on it is a picture of the confectionery contained in the container body 2, a trademark and the like.

The exterior shell 4 can be easily removed from the container body 2 because the exterior shell 4 is retained on the container body 2 only by the smaller end engaging upper portions of the protrusions 8 and can be used as a stand as shown in FIG. 1. When necessary, the exterior shell 4 can be fitted again on the container body 2 as shown in FIG. 3.

Figure 6:
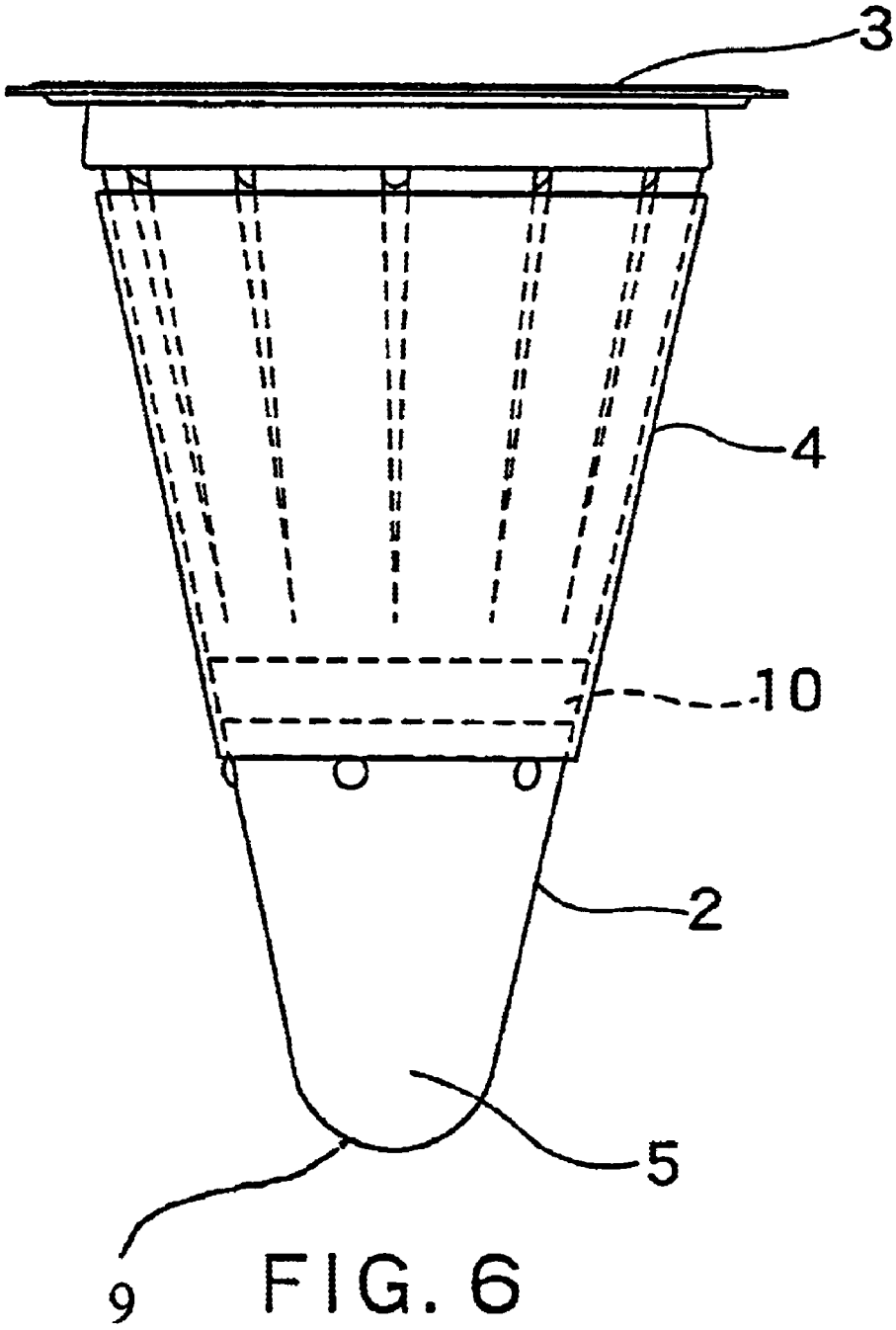
FIG. 6 is a side elevational view of a packaging container in a modification of the packaging container shown in FIG. 1.

FIG. 6 shows a packaging container in a modification of the packaging container 1 shown in FIGS. 1 to 5, in which parts like or corresponding to those of the packaging container 1 shown in FIGS. 1 to 5 are denoted by the same reference characters and the description thereof will be omitted. As shown in FIG. 6, an exterior shell 4 may be fitted on a container body 2 and may be held on the container body 2 by lightly bonding a smaller end portion 10 of the exterior shell, with an adhesive or the like, to an outer surface of the container body 2 instead of by engaging the smaller end thereof with protrusions 8 formed on the outer surface of the container body 2 so that the exterior shell 4 can be separated from the container body 2 by applying a small force thereto. The exterior shell 4 is removed from the container body 2 by applying a small force thereto and is inverted. Tapered end portion 5 of the container body 2 is inserted into the inverted exterior shell 4 so as to use the inverted exterior shell 4 as a support. Since the exterior shell 4 has a shape resembling a frustum, the smaller end portion 10 can be fitted onto the container body 2 by passing the tapered end portion 5 through the exterior shell 4 without using any protrusions. It is troublesome to put the exterior shell 4 once removed from the container body 2 again onto the container body 2 and to bond the smaller end portion 10 lightly again to the container body 2. Therefore, the packaging container shown in FIG. 6 is useful for containing confectionery 15 that is expected to be eaten up all at once.

Although the invention has been described as applied to packaging containers for containing confectionery, the present invention is not limited thereto in its practical application and may be applied to packaging containers for containing articles other than confectionery, such as pickles and the like.

As is apparent from the foregoing description, the exterior shell of the packaging container of the present invention can be used as a label and a stand, the container body having a shape substantially resembling an inverted cone can be set alone on the support surface, and the contents, such as confectionery, contained in the container body can be removed without holding the packaging container by hand.

What is claimed is:

1. A packaging container comprising:

a container body having an inverted cone shape, said container body including a side wall, a first end defined by a tapered end portion having a rounded distal end, an open end opposite said first end, an axis passing through said rounded distal end and said open end, and a first portion extending away from said side wall at said open end in a direction toward said axis;

a flange at said open end, said flange including a first portion extending in a radial direction of said container body away from said first portion; of said container body, and also including a second portion extending outwardly away from an outer periphery of said first portion of said flange;

at least one protrusion formed on an outer surface of said side wall of said container body;

a frustum-shaped exterior shell having a small-diameter opening at one end and a large-diameter opening at an opposite end such that (i) said frustum-shaped exterior shell is to be removably fitted onto said container body by passing said tapered end portion of said container body through said large-diameter opening and then through said small-diameter opening until said at least one protrusion removably supports said frustum-shaped exterior shell on said container body, and (ii) said frustum-shaped exterior shell is to support said container body on the support surface in an upright position by removing said frustum-shaped exterior shell from said container body, inverting said frustum-shaped exterior shell, inserting said tapered end portion of said container body into said small-diameter opening of said frustum-shaped exterior shell until said at least one protrusion is engaged by said one end of said frustum-shaped exterior shell, and placing said opposite end of said frustum-shaped exterior shell on the support surface; and a lid for hermetically sealing said container body, said lid including a first portion that is to be received within said first portion of said container body, and also including a second portion that is to be received on said first portion of said flange when said first portion of said lid is received within said first portion of said container body, said second portion of said lid terminating at an outer peripheral edge thereof such that when said second portion of said lid is on said first portion of said flange said outer peripheral edge is surrounded by and positioned radially inwardly of said second portion of said flange.

2. The packaging container according to claim 1, wherein said frustum-shaped exterior shell has an axial length such that when said frustum-shaped exterior shell supports said container body by removing said frustum-shaped exterior shell from said container body, inverting said frustum-shaped exterior shell, inserting said tapered end portion of said container body into said small-diameter opening of said frustum-shaped exterior shell until said at least one protrusion is engaged by said one end of said frustum-shaped exterior shell, and placing said opposite end of said frustum-shaped exterior shell on the support surface, said rounded distal end of said container body is spaced from the support surface.

3. The packaging container according to claim 1, wherein said at least one protrusion is on a portion of said side wall of said container body that is between an axial central portion of said container body and said first end.

4. The packaging container according to claim 1, wherein said at least one protrusion comprises plural protrusions in a plane that is perpendicular to an axis of said container body.

5. The packaging container according to claim 4, wherein said frustum-shaped exterior shell has an axial length such that when said frustum-shaped exterior shell supports said container body by removing said frustum-shaped exterior shell from said container body, inverting said frustum-shaped exterior shell, inserting said tapered end portion of said container body into said small-diameter opening of said frustum-shaped exterior shell until said at least one protrusion is engaged by said one end of said frustum-shaped exterior shell, and placing said opposite end of said frustum-shaped exterior shell on the support surface, said rounded distal end of said container body is spaced from the support surface.

6. The packaging container according to claim 4, wherein said plural protrusions are on a portion of said side wall of said container body that is between an axial central portion of said container body and said first end.

7. The packaging container according to claim 1, further comprising grooves in said side wall, said grooves tapering in a direction from said open end toward said rounded distal end.

8. The packaging container according to claim 7, wherein said frustum-shaped exterior shell has an axial length such that when said frustum-shaped exterior shell supports said container body by removing said frustum-shaped exterior shell from said container body, inverting said frustum-shaped exterior shell, inserting said tapered end portion of said container body into said small-diameter opening of said frustum-shaped exterior shell until said at least one protrusion is engaged by said one end of said frustum-shaped exterior shell, and placing said opposite end of said frustum-shaped exterior shell on the support surface, said rounded distal end of said container body is spaced from the support surface.

* * * * *